US007639218B2

(12) United States Patent
Lee et al.

(10) Patent No.: US 7,639,218 B2
(45) Date of Patent: Dec. 29, 2009

(54) ORGANIC LIGHT EMITTING DISPLAY DEVICE HAVING AUTOMATIC BRIGHTNESS CONTROL APPARATUS

(75) Inventors: Jae-Sung Lee, Suwon-si (KR); Choon-Yul Oh, Suwon-si (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 673 days.

(21) Appl. No.: 11/506,582

(22) Filed: Aug. 18, 2006

(65) Prior Publication Data

US 2007/0040774 A1 Feb. 22, 2007

(30) Foreign Application Priority Data

Aug. 22, 2005 (KR) ..... 10-2005-0076993

(51) Int. Cl.
*G09G 3/30* (2006.01)

(52) U.S. Cl. ..... 345/77; 345/102; 345/207

(58) Field of Classification Search ..... None
See application file for complete search history.

(56) References Cited

U.S. PATENT DOCUMENTS

| | | | | |
|---|---|---|---|---|
| 2001/0015725 | A1* | 8/2001 | Nakanishi et al. | 345/207 |
| 2004/0095402 | A1* | 5/2004 | Nakano | 346/102 |
| 2005/0008382 | A1* | 1/2005 | Taguchi et al. | 399/66 |
| 2006/0001641 | A1* | 1/2006 | Degwekar et al. | 345/102 |
| 2007/0035489 | A1* | 2/2007 | Lee | 345/77 |

FOREIGN PATENT DOCUMENTS

| | | | |
|---|---|---|---|
| JP | 2002-229511 | A | 8/2002 |
| JP | 2002-297096 | A | 10/2002 |
| KR | 10-2004-0005224 | A | 1/2004 |

OTHER PUBLICATIONS

Patent Abstracts of Japan, Publication No. 2002-229511, Date of publication Aug. 16, 2002, Yoshida Takayoshi, et al.
Patent Abstracts of Japan, Publication No. 2002-297096, Date of publication Oct. 9, 2002, Nakamura Kazuo.
Korean Patent Abstracts, Publication No. 1020040005224 A, Date of publication Jan. 16, 2004, Shin, Dong Yong.

* cited by examiner

*Primary Examiner*—Amare Mengistu
*Assistant Examiner*—Antonio Xavier
(74) *Attorney, Agent, or Firm*—Christie, Parker & Hale, LLP

(57) ABSTRACT

An organic light emitting display (OLED) device having an automatic brightness control apparatus that can control the luminance of the OLED device according to the brightness of ambient light. The OLED device includes a light sensor adapted to sense ambient light and produce an output voltage corresponding to the ambient light. The automatic brightness control apparatus is adapted to adjust a gamma value to the output voltage and output a gamma reference voltage. The automatic brightness control apparatus is adapted to sense a change in the ambient light by synchronizing the output voltage of the light sensor with a vertical synchronization (Vsync) signal. Accordingly, the gamma value varies with the brightness of the ambient light so that the luminance of the OLED device is controlled according to the brightness of the ambient light.

13 Claims, 5 Drawing Sheets

ORGANIC LIGHT EMITTING DISPLAY DEVICE HAVING AUTOMATIC BRIGHTNESS CONTROL APPARATUS

CROSS-REFERENCE TO RELATED APPLICATION

This application claims priority to and the benefit of Korean Patent Application No. 10-2005-0076993, filed Aug. 22, 2005, in the Korean Intellectual Property Office, the entire content of which is incorporated herein by reference.

BACKGROUND OF THE INVENTION

1. Field of the Invention

The present invention relates to an organic light emitting display (OLED) device (or organic electroluminescent display device), and more particularly, to an OLED device having an automatic brightness control apparatus that can control the luminance of an image display portion according to the brightness of ambient light.

2. Description of the Related Art

An organic light emitting display (OLED) device is a display device in which electrons and holes are injected into an organic thin layer through a cathode and an anode and recombined to generate excitons, thus emitting light of a certain wavelength. Since the OLED device makes use of self emissive display devices, it requires no additional light source unlike a liquid crystal display (LCD).

Also, the luminance of an organic light emitting diode constituting the OLED device depends on the amount of current flowing through the organic light emitting diode.

The OLED devices may be classified into a passive matrix type and an active matrix type depending on the driving method. The passive matrix OLED device includes anodes and cathodes, which are arranged perpendicular to each other, and is driven by selecting a line. Since the passive matrix OLED device has a simple configuration, it can be realized by a simple process. However, in realizing a large screen, the passive matrix OLED device consumes a large amount of current and cannot drive each light emitting diode for a long time.

On the contrary, the active matrix OLED device controls the amount of current supplied to a light emitting diode using an active device. A thin film transistor (TFT) is typically used as the active device. Although the active matrix OLED device has a comparatively complicated construction, it consumes a small amount of current and can extend an emission time.

A typical OLED device emits light at a range of luminance irrespective of ambient light. Thus, even if the ambient light is dark, the OLED device may emit light at high luminance. The life span of an organic light emitting diode depends on the amount of current flowing through the diode. When the organic light emitting diode emits light at unnecessarily high luminance, the amount of current flowing through the organic light emitting diode increases. As a result, the lifetime of the organic light emitting diode decreases and power consumption increases.

For these reasons, it is desirable to control the luminance of the organic light emitting diode according to ambient light.

SUMMARY OF THE INVENTION

Exemplary embodiments according to the present invention provide an organic light emitting display (OLED) device having an automatic brightness control apparatus in which a gamma value quickly varies with the brightness of ambient light so that the luminance of the OLED device is controlled according to the brightness of the ambient light.

In an exemplary embodiment of the present invention, an OLED device includes: a display panel having a plurality of pixels and adapted to display an image with luminance that varies with brightness of ambient light; a scan driver adapted to output a scan signal to select the pixels; a data driver adapted to apply a data signal to the pixel selected by the scan signal; an emission control driver adapted to apply an emission control signal to control emission of the pixel to which the data signal is applied; a light sensor adapted to sense the ambient light and output a voltage corresponding to the sensed ambient light; and an automatic brightness controller adapted to receive the output voltage of the light sensor, adjust a gamma value to a luminance corresponding to the output voltage, and apply a gamma reference voltage to the data driver, wherein the automatic brightness controller is adapted to sense a change in the ambient light by synchronizing the output voltage of the light sensor with a vertical synchronization (Vsync) signal.

In another exemplary embodiment of the present invention, an automatic brightness control apparatus, which is adapted to receive an output voltage produced by a light sensor according to ambient light, and adjust a gamma value to a luminance corresponding to the output voltage of the light sensor to automatically control the luminance of an organic light emitting display device, includes: an analog-to-digital (A/D) converter adapted to receive the output voltage of the light sensor, compare the output voltage of the light sensor with a preset reference voltage, and convert the output voltage of the light sensor into a digital signal; a Vsync counter adapted to receive a vertical synchronization (Vsync) signal, count the Vsync signal a number of times, and outputting the Vsync signal; an A/D controller adapted to receive the digital signal from the A/D converter, synchronize the digital signal with the Vsync signal output from the Vsync counter, and output a control signal; a gamma controller adapted to output one of previously stored gamma values in response to the control signal output from the A/D controller; a first automatic brightness controller adapted to control operations of the A/D converter, the Vsync counter, the A/D controller, and the gamma controller; and a gamma circuit adapted to output a gamma reference voltage corresponding to the gamma value output from the gamma controller, wherein the AND controller is adapted to sense a change in the output voltage of the light sensor by synchronizing the output voltage of the light sensor with the Vsync signal.

In still another exemplary embodiment of the present invention, an automatic brightness control apparatus, adapted to control a gamma value according to an output voltage of a light sensor to automatically control the luminance of an organic light emitting display device, the automatic brightness control apparatus including: an AND converter adapted to receive the output voltage of the light sensor, compare the output voltage of the light sensor with a preset reference voltage, and convert the output voltage of the light sensor into a digital signal; a Vsync counter adapted to receive a vertical synchronization (Vsync) signal, count the Vsync signal a number of times, and output the Vsync signal; an A/D controller receiving the digital signal from the A/D converter, synchronize the digital signal with the Vsync signal output from the Vsync counter, and output a control signal; a gamma controller adapted to output one of previously stored gamma values in response to the control signal output from the A/D controller; a first automatic brightness controller adapted to control the operations of the A/D converter, the Vsync counter, the A/D controller, and the gamma controller.

BRIEF DESCRIPTION OF THE DRAWINGS

The above and other features of the present invention will be described with reference to certain exemplary embodiments thereof with reference to the attached drawings in which.

DETAILED DESCRIPTION

The present invention will now be described more fully hereinafter with reference to the accompanying drawings, in which exemplary embodiments of the invention are shown.

Figure 1:
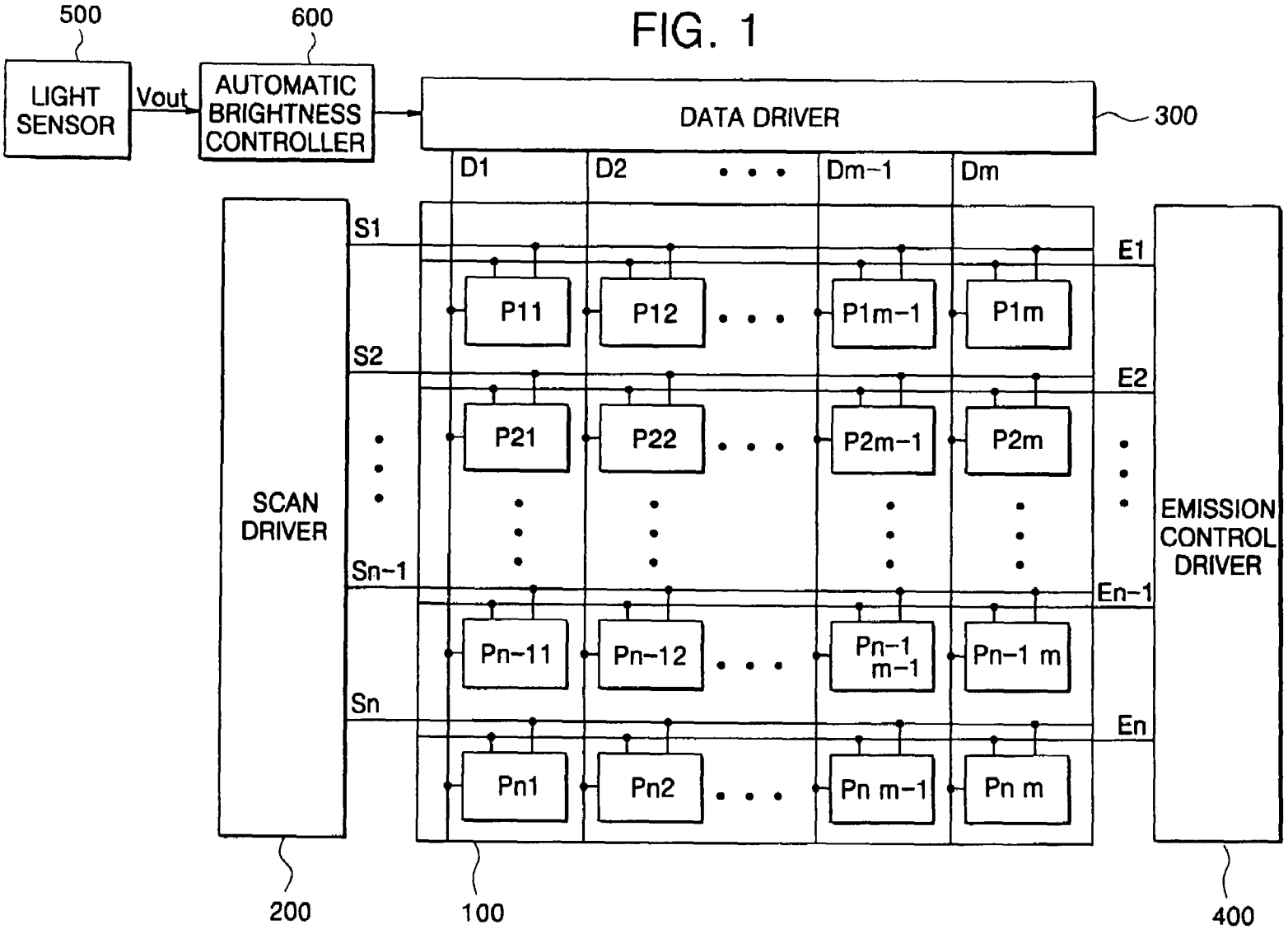
FIG. 1 is a block diagram of an organic light emitting display (OLED) device having an automatic brightness controller according to an exemplary embodiment of the present invention.

FIG. 1 is a block diagram of an organic light emitting display (OLED) device having an automatic brightness controller according to an exemplary embodiment of the present invention.

Referring to FIG. 1, the OLED device according to an exemplary embodiment of the present invention includes a display panel 100, a scan driver 200, a data driver 300, an emission control driver 400, a light sensor 500, and an automatic brightness controller 600.

The display panel 100 includes a plurality of signal lines arranged in rows and columns. In the embodiment illustrated in FIG. 1, the signal lines are divided into a plurality of data lines D1-Dm extending in a direction, a plurality of scan lines S1-Sn and a plurality of emission control lines E1-En extending in a row direction.

A plurality of pixels P11-Pnm are formed in regions where the data lines D1-Dm cross over the scan lines S1-Sn and the emission control lines E1-En. The pixels P11-Pnm emit light with luminance corresponding to data signals transmitted to the data lines D1-Dm. Each of the pixels P11-Pnm includes a pixel driver (not shown) and an organic light emitting diode (not shown). The pixel driver outputs a driving current corresponding to the data signal and includes a plurality of transistors and one or more capacitors. The organic light emitting diode emits light with a luminance corresponding to the driving current and includes an anode electrode, an emission layer, and a cathode electrode, which are sequentially stacked.

The scan driver 200 is connected to the scan lines S1-Sn and applies scan signals for selecting the pixels P11-Pnm. In one embodiment, the scan signals are applied for selecting the pixels P11-Pnm.

The data driver 300 is connected to the data lines D1-Dm and applies data signals to the pixels selected by the scan signals.

The emission control driver 400 is connected to the emission control lines E1-En and applies emission control signals for controlling the emission of the pixels to which the data signals are applied.

The light sensor 500 senses the brightness of ambient light and produces a voltage signal Vout corresponding to the sensed brightness.

The automatic brightness controller 600 controls a gamma reference voltage applied to the data driver 300 according to the voltage signal Vout applied from the light sensor 500. That is, the automatic brightness controller 600 controls a range of the gamma reference voltage, which determines an analog data voltage, according to the brightness of ambient light, so that the entire luminance of the OLED device can be controlled.

In one embodiment, the automatic brightness controller 600 is internally structured such that the gamma reference voltage range is divided into four levels and stored in a gamma register. However, the present invention is not limited thereto, and the gamma reference voltage range may be expanded or reduced. Additionally, the number of levels into which the voltage range is divided can be less than or greater than four.

As the OLED device according to the exemplary embodiment of the present invention has the above-described construction, it can clearly display an image by elevating a luminance level in a bright place and lowering the luminance level in a dark place.

Hereinafter, the structure and operation of the automatic brightness controller 600 will be described in detail.

Figure 2:
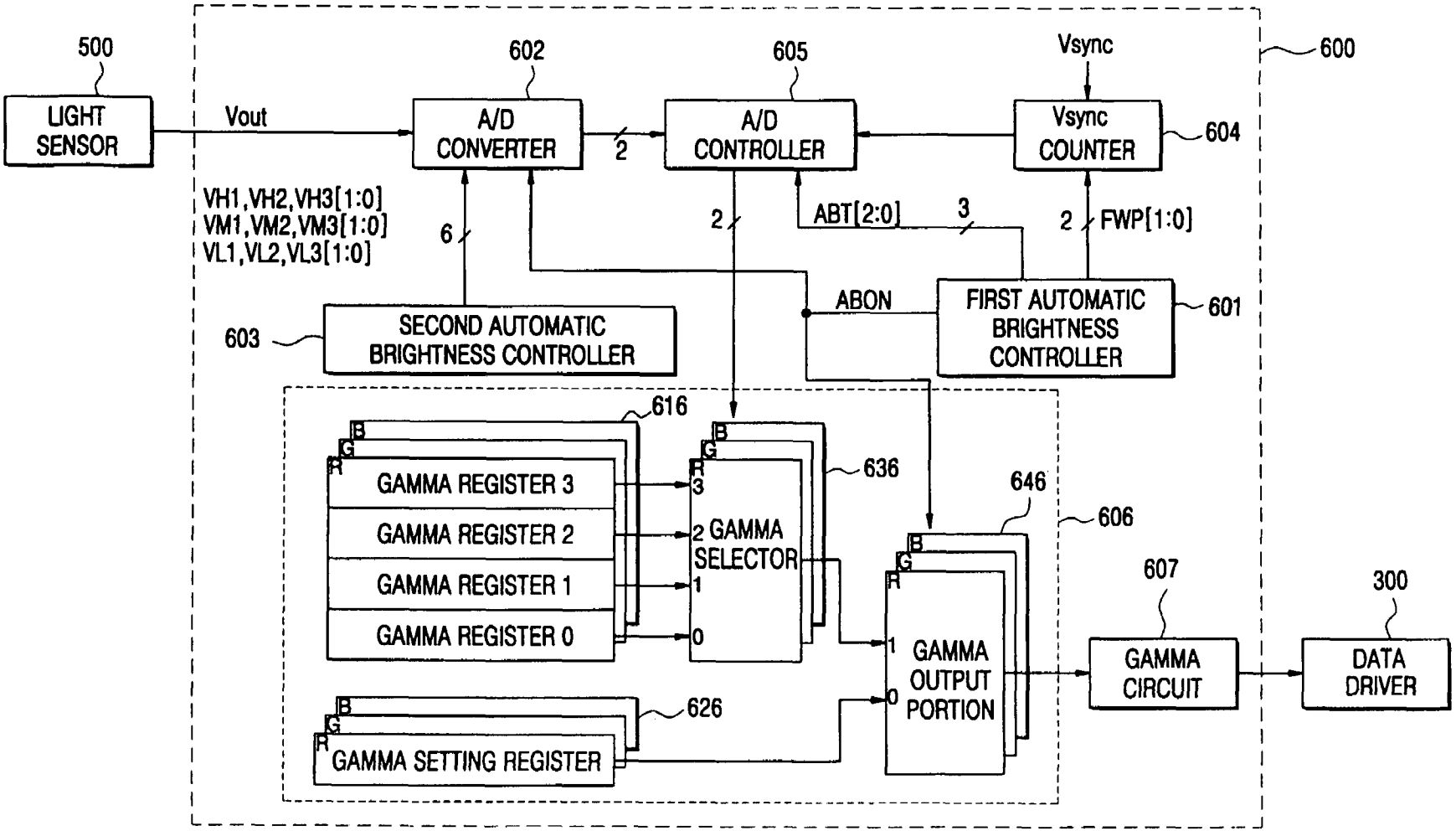
FIG. 2 is a detailed internal construction diagram of the automatic brightness controller shown in FIG. 1.

FIG. 2 is a detailed internal construction diagram of the automatic brightness controller shown in FIG. 1.

Referring to FIG. 2, the automatic brightness controller 600 includes a first automatic brightness controller 601, an analog-to-digital (A/D) converter 602, a second automatic brightness controller 603, a Vsync counter 604, an A/D controller 605, a gamma controller 606, and a gamma circuit 607.

The first automatic brightness controller 601 transmits control signals to respective components to operate the automatic brightness controller 600. That is, a user can adjust the display device to an automatic brightness control mode by using the first automatic brightness controller 601. Accordingly, the A/D converter 602, the Vsync counter 604, the A/D controller 605, and the gamma controller 606 are enabled in response to an automatic brightness control mode signal ABON of the user.

The A/D converter 602 receives a voltage signal Vout from the light sensor 500 and outputs a 2-bit digital value corresponding to the voltage signal Vout. That is, the A/D converter 602 controls the luminance of the display device to four levels, i.e., a very dark level (00), a dark level (01), an indoor level (10), and an outdoor level (11), according to the brightness of ambient light.

In this case, the A/D converter 602 receives a 6-bit digital control signal from the second automatic brightness controller 603. The 6-bit digital control signal is used to select a reference voltage that may be compared with the voltage signal Vout of the light sensor 500. The reference voltage selected by the second automatic brightness controller 603 is determined by a hysteresis graph shown in FIG. 3.

Figure 3:
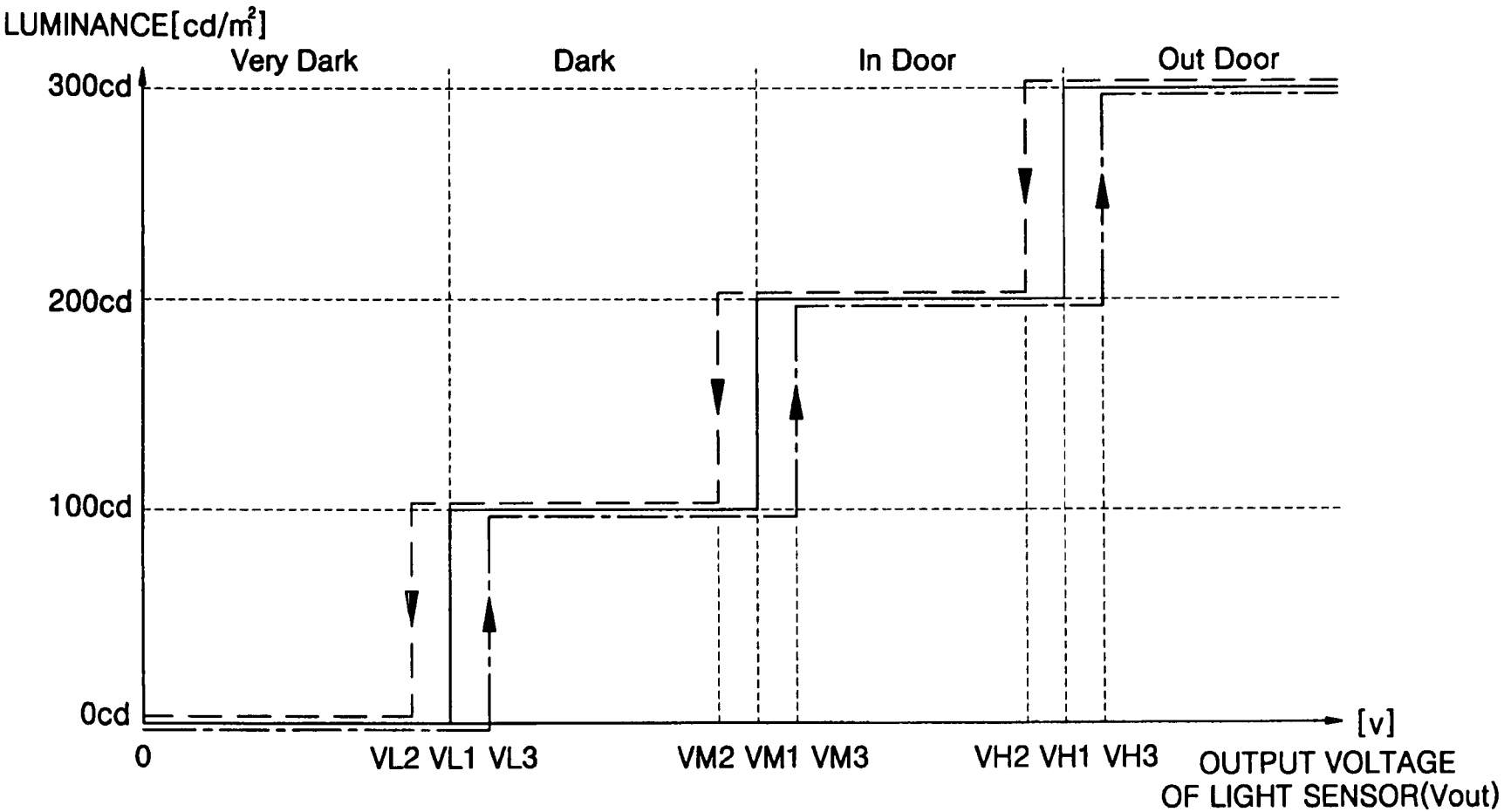
FIG. 3 is a graph showing a hysteresis loop for determining a reference voltage that is set by an analog-to-digital (A/D) converter of FIG. 2.

FIG. 3 is a graph showing a hysteresis loop for determining a reference voltage that is set by the A/D converter 602 of FIG. 2.

Referring to FIG. 3, a vertical axis denotes luminance [cd/m$^2$], and a horizontal axis denotes an output voltage Vout [V] of the light sensor 500. Also, a very dark region, which ranges from 0 to the lowest voltage VL (VL1-VL3), has a luminance of about 10 cd/m$^2$, and a dark region, which ranges from the lowest voltage VL to a middle voltage VM (VM1-VM3), has a luminance of about 100 cd/m$^2$. Also, an indoor region, which ranges from the middle voltage VM to the highest voltage VH (VH1-VH3), has a luminance of about 200 cd/m$^2$, and an outdoor region, which is not less than the highest voltage VH, has a luminance of about 300 cd/m$^2$.

As described above, when the voltage Vout corresponding to ambient light sensed by the light sensor 500 belongs to one of the four regions of the hysteresis graph of FIG. 3, the A/D converter 602 outputs a corresponding 2-bit digital signal.

In FIG. 3, the foregoing hysteresis is divided into a normal mode (step 1) and a hysteresis mode (step 2 or step 3). That is, in the normal mode (i.e., when hysteresis is not exhibited), intermediate voltage values VL1, VM1, and VH1 are determined as reference voltages. On the other hand, in the hysteresis mode, left voltage values (VL2, VM2, and VH2 (step 2)) or right voltage values (VL3, VM3, and VH3 (step 3)) are determined as reference voltages.

Here, embodiments of reference voltage values in the normal mode (step 1) and the hysteresis mode (step 2 or step 3) are arranged in the following Tables.

1) Normal Mode (Hysteresis off: Step 1)

| VH1[1:0] | Voltage | VM1[1:0] | Voltage | VL1[1:0] | Voltage |
|---|---|---|---|---|---|
| 00 | 0.6 | 00 | **0.3** | 00 | **0.1** |
| 01 | **1.2** | 01 | 0.4 | 01 | 0.2 |
| 10 | 1.6 | 10 | 0.5 | 10 | 0.3 |
| 11 | 2.0 | 11 | 0.6 | 11 | 0.4 |

*Underlined bold figures denote default values.

2) Hysteresis Mode (Step 2)

| VH2[1:0] | Voltage | VM2[1:0] | Voltage | VL2[1:0] | Voltage |
|---|---|---|---|---|---|
| 00 | 0.4 | 00 | 0.15 | 00 | 0.06 |
| 01 | 0.8 | 01 | 0.2 | 01 | 0.08 |
| 10 | **0.9** | 10 | **0.25** | 10 | **0.10** |
| 11 | 1.0 | 11 | 0.3 | 11 | 0.12 |

*Underlined bold figures denote default values.

3) Hysteresis Mode (Step 3)

| VH3[1:0] | Voltage | VM3[1:0] | Voltage | VL3[1:0] | Voltage |
|---|---|---|---|---|---|
| 00 | 0.6 | 00 | 0.2 | 00 | 0.07 |
| 01 | 1.2 | 01 | 0.3 | 01 | 0.1 |
| 10 | 1.4 | 10 | 0.4 | 10 | 0.13 |
| 11 | **1.6** | 11 | **0.5** | 11 | **0.15** |

*Underlined bold figures denote default values.

As shown in the above Tables, the reference voltage is determined depending on whether the hysteresis is in the normal mode or in the hysteresis mode. The user can select the mode of the hysteresis using the second automatic brightness controller 603. When the user selects a mode (which may be predetermined), the underlined bold default values are determined as reference voltages. However, the default values are freely changeable by the user as shown in the Tables.

Referring again to FIG. 2, the Vsync counter 604 receives a vertical synchronization signal (hereinafter, a "Vsync signal"), counts the Vsync signal under the control of the first automatic brightness controller 601, and outputs a 2-bit digital signal. That is, the first automatic brightness controller 601 transmits the 2-bit digital signal to the Vsync counter 604. The Vsync counter 604 counts the Vsync signal once (2-bit: 00), twice (2-bit:01), three times (2-bit:10), or four times (2-bit:11) in response to the 2-bit digital signal 00, 01, 10, or 11, respectively, and outputs the 2-bit digital signal to the A/D controller 605.

The A/D controller 605 synchronizes the 2-bit digital signal received from the A/D converter 602 with the Vsync signal input from the Vsync counter 604, and outputs the synchronized signal to the gamma controller 606. In the described embodiment, the first automatic brightness controller 601 transmits a 3-bit digital signal ABT[2:0] to the A/D controller 605 and samples a brightness control synchronization signal using the Vsync signal output from the Vsync counter 604. Table 1 shows 3-bit digital signals and sampling periods.

TABLE 1

| ABT[2:0] | Sampling Period |
|---|---|
| 000 | 1 * Vsync |
| 001 | 2 * Vsync |
| 010 | 3 * Vsync |
| 011 | 8 * Vsync |
| 100 | 16 * Vsync |
| 101 | 32 * Vsync |
| 110 | 64 * Vsync |
| 111 | No action |

As can be seen from Table 1, the Vsync signal is multiplied by a value corresponding to the 3-bit digital signal ABT[2:0] output from the first automatic brightness controller 601 and sampled. Accordingly, the gamma reference voltage varies with luminance corresponding to the output voltage Vout of the light sensor 500 and is output in synchronization with the brightness control synchronization signal.

The gamma controller 606 receives the 2-bit digital signal from the A/D controller 605 and controls a gamma value. The gamma controller 606 includes a gamma register 616, a gamma setting register 626, a gamma selector 636, and a gamma output portion 646.

The gamma register 616 stores gamma values corresponding to the four hysteresis regions as shown in FIG. 3. That is, the gamma register 616 may be divided into a gamma register 0 for storing a gamma value corresponding to a very dark region, a gamma register 1 for storing a gamma value corresponding to a dark region, a gamma register 2 for storing a gamma value corresponding to an indoor region, and a gamma register 3 for storing a gamma value corresponding to an outdoor region. Also, the gamma register 616 stores red, green, and blue gamma values.

The gamma setting register 626 stores initially set red, green, and blue gamma values when the automatic brightness controller 600 is off. Accordingly, when the automatic brightness control mode is off, a gamma reference voltage corresponding to a gamma value stored in the gamma setting register 626 is set.

The gamma selector 636 selects a gamma value (which may be predetermined) from the gamma register 616 in response to the 2-bit digital signal output from the A/D controller 605 and outputs the selected gamma value to the gamma output portion 646.

When the automatic brightness control mode signal ABON is turned on by the first automatic brightness controller 601, the gamma output portion 646 is switched to the gamma selector 636 to select one of the gamma registers 616. When the automatic brightness control mode signal ABON is turned off, the gamma output portion 646 selects the gamma setting register 626 and outputs a gamma value to the gamma circuit 607.

The gamma circuit 607 receives the gamma value from the gamma output portion 646, generates a gamma reference voltage corresponding to the gamma value, and transmits the gamma reference voltage to the data driver 300.

The above-described automatic brightness controller 600 transmits a gamma reference voltage corresponding to one of preset four brightness levels according to the output voltage Vout based on the brightness of ambient light sensed by the light sensor 500 to the data driver 300 and changes the entire brightness (luminance) of the panel. A time (e.g., delay time) taken to output the gamma reference voltage to the data driver 300 after the automatic brightness controller 600 senses the voltage Vout based on the brightness of ambient light sensed by the light sensor 500 depends on how the Vsync signal is synchronized.

The delay time will now be described in detail with reference to FIGS. 4A and 4B.

Figure 4A:
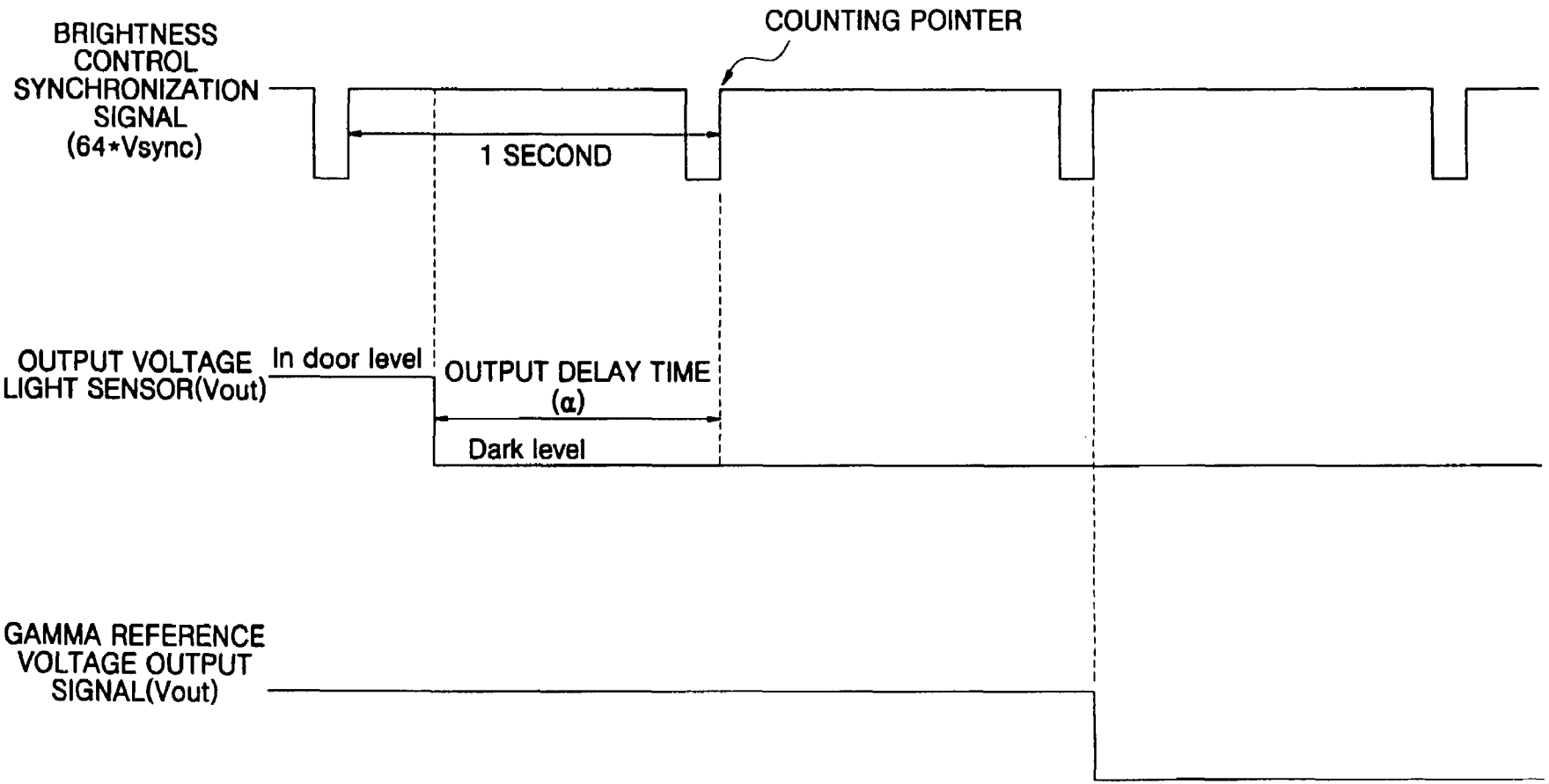
FIG. 4A is a conventional timing diagram illustrating the operation of the automatic brightness controller shown in FIG. 2.
Figure 4B:
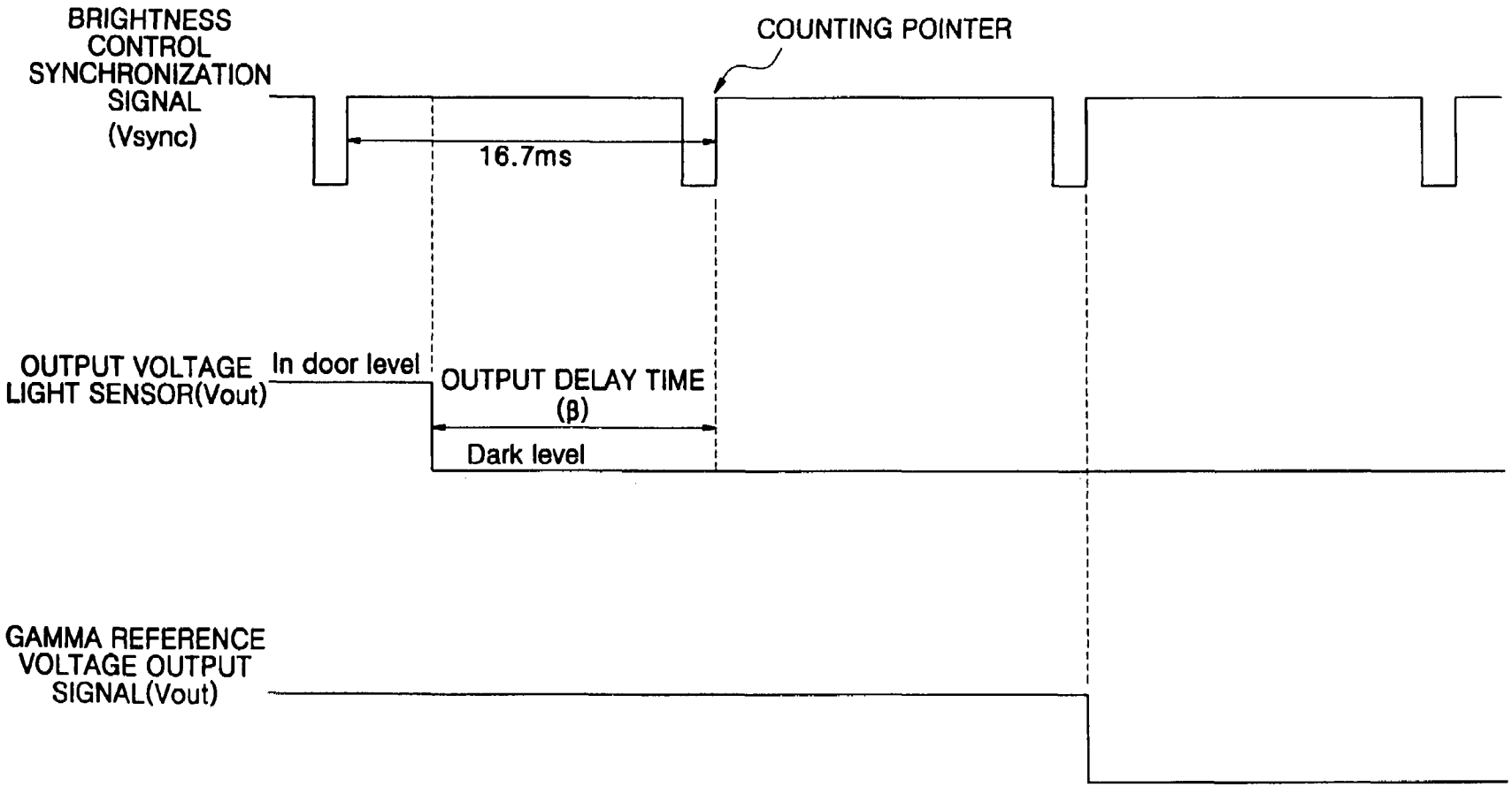
FIG. 4B is a timing diagram of the present invention illustrating the operation of the automatic brightness controller shown in FIG. 2.

FIG. 4A is a conventional timing diagram illustrating the operation of the automatic brightness controller shown in FIG. 2, and FIG. 4B is a timing diagram of the present invention illustrating the operation of the automatic brightness controller shown in FIG. 2.

Referring to FIG. 4A, the brightness control synchronization signal is synchronized as a 64*Vsync signal. Generally, a display device that operates at a frequency of 60 Hz outputs a synchronization signal of a Vsync signal at intervals of 1/60 seconds (about 16.7 ms). Therefore, the automatic brightness controller 600 outputs a synchronization signal of the 64*Vsync signal at intervals of 64*16.7 ms (about 1 second) and senses the output signal Vout of the light sensor 500.

That is, when the output signal Vout of the light sensor 500 is changed from an indoor region level (or indoor level) to a dark region level (or dark level) as shown in FIG. 4A, the automatic brightness controller 600 senses a change in the output signal Vout of the light sensor 500 according to the brightness control synchronization signal (64*Vsync) at a point in time of a counting pointer, and a gamma reference voltage output signal is output at the same time as the next synchronization signal is generated. As a result, the luminance of the entire display device is changed.

In this case, an output delay time $\alpha$ is taken until the automatic brightness controller 600 senses the change in the output signal Vout of the light sensor 500 according to the brightness control synchronization signal (64*Vsync). Here, the output delay time $\alpha$ may have a maximum value of 64*Vsync (about 1 second). Therefore, the luminance of the display device does not quickly respond to the change of the output signal Vout of the light sensor 500.

Referring to FIG. 4B, the brightness control synchronization signal is synchronized according to a Vsync signal unlike in FIG. 4A. Accordingly, the automatic brightness controller 600 outputs a synchronization signal of the brightness control synchronization signal (Vsync) at intervals of 1/60 seconds (about 16.7 ms) and senses the output signal Vout of the light sensor 500.

That is, when the output signal Vout of the light sensor 500 is changed from an indoor region level to a dark region level as shown in FIG. 4B, the automatic brightness controller 600 senses a change in the output signal Vout of the light sensor 500 according to the brightness control synchronization signal (Vsync) at a point in time of a counting pointer, and a gamma reference voltage output signal is output at the same time as the next synchronization signal is generated. As a result, the luminance of the entire display device is changed.

In this embodiment, an output delay time $\beta$ is taken until the automatic brightness controller 600 senses the change in the output signal Vout of the light sensor 500 according to the brightness control synchronization signal (Vsync). Here, the output delay time $\beta$ may have a maximum value of Vsync (about 16.7 ms). As described above, in making use of the brightness control synchronization signal (Vsync), since the output delay time $\beta$ (a maximum of about 16.7 ms) is shorter than the conventional output delay time $\alpha$ (64*Vsync=about a maximum of 1 second), the automatic brightness controller 600 can quickly respond to the change in the output signal Vout affected by the brightness of ambient light sensed by the light sensor 500 and change the luminance of the display.

Hereinafter, operation of the automatic brightness controller 600 will be described in detail with reference to FIGS. 2, 3 and 4B.

For the sake of brevity and conciseness, operation of the automatic brightness controller 600 will be narrowed down to the case where the second automatic brightness controller 603 is in the hysteresis mode (step 2).

Assuming that the output voltage Vout affected by ambient light sensed by the light sensor 500 is 0.3 V, the A/D converter 602 compares the output voltage Vout with reference voltages belonging to the hysteresis mode (step 2) and transmits the 2-bit digital value "10" corresponding to the indoor region to the A/D controller 605.

The A/D controller 605 synchronizes an output signal of the light sensor 500 with the brightness control synchronization signal (i.e., the Vsync signal) in response to a control signal output from the first automatic brightness controller 601 and transmits a control signal for selecting the gamma register corresponding to the indoor region to the gamma controller 606.

Thus, the gamma controller 606 transmits a gamma reference voltage to the data driver 300 such that the display device emits light with a luminance of about 200 cd/m$^2$.

Also, the OLED device of the present invention includes the automatic brightness controller, which senses a change in ambient light by synchronizing the output signal of the light sensor with the brightness control synchronization signal. As a result, an output delay time taken until the luminance of the display device is changed can be reduced to as short as about 16.7 ms, so that the display device can quickly respond to the change in ambient light.

According to the exemplary embodiments of the present invention as explained thus far, a gamma value varies with the brightness of ambient light so that the luminance of the OLED device is controlled according to the brightness of the ambient light. Thus, the life span of pixels can increase and power consumption can decrease.

Also, the OLED device of the exemplary embodiments of the present invention includes the automatic brightness controller, which senses a change in ambient light by synchronizing the output signal of the light sensor with the brightness control synchronization signal. As a result, an output delay time taken until the luminance of the display device is changed can be reduced to shorter than about 16.7 ms, as shown in FIG. 4B, so that the display device can quickly respond to a change in ambient light.

Although the present invention has been described with reference to certain exemplary embodiments thereof, it will be understood by those skilled in the art that a variety of modifications and variations may be made to the present invention without departing from the spirit or scope of the present invention defined in the appended claims, and their equivalents.

What is claimed is:

1. An organic light emitting display (OLED) device comprising:

a display panel having a plurality of pixels and adapted to display an image with luminance that varies with a brightness of ambient light;

a scan driver adapted to output a scan signal to select the pixels;

a data driver adapted to apply a data signal to the pixels selected by the scan signal;

an emission control driver adapted to apply an emission control signal to control emission of the pixels to which the data signal is applied;

a light sensor adapted to sense the ambient light and output a voltage corresponding to the sensed ambient light; and an automatic brightness controller adapted to receive the output voltage of the light sensor, adjust a gamma value to a luminance corresponding to the output voltage, and apply a gamma reference voltage to the data driver, wherein the automatic brightness controller is adapted to sense a change in the ambient light by synchronizing the output voltage of the light sensor with a vertical synchronization (Vsync) signal.

2. The OLED device of claim 1, wherein the automatic brightness controller comprises:

an A/D converter adapted to receive the output voltage of the light sensor, compare the output voltage of the light sensor with a reference voltage, and convert the output voltage of the light sensor to a digital signal;

a Vsync counter adapted to receive the Vsync signal, count the Vsync signal a number of times, and output the Vsync signal;

an A/D controller adapted to receive the digital signal from the A/D converter, synchronize the digital signal with the Vsync signal output from the Vsync counter, and output a control signal;

a gamma controller adapted to output one of a plurality of previously stored gamma values in response to the control signal output from the A/D controller;

a first automatic brightness controller adapted to control operations of the A/D converter, the Vsync counter, the A/D controller, and the gamma controller; and a gamma circuit adapted to output a gamma reference voltage corresponding to one of the previously stored gamma values output from the gamma controller.

3. The OLED device of claim 2, wherein the gamma controller comprises:

a gamma register adapted to store a number of gamma values, one of which is selected when an automatic brightness control mode is turned on;

a gamma setting register adapted to store a reference gamma value that is selected when the automatic brightness control mode is turned off;

a gamma selector adapted to select a gamma value from the gamma register in response to the control signal output from the A/D controller; and a gamma output portion adapted to output to the gamma circuit the gamma value selected by the gamma selector under the control of the first automatic brightness controller.

4. The OLED device of claim 3, wherein the gamma values comprise red, green, and blue gamma values.

5. The OLED device of claim 4, wherein the automatic brightness controller further comprises a second automatic brightness controller adapted to transmit a control signal to select the reference voltage compared with the output voltage of the light sensor to the A/D converter.

6. An automatic brightness control apparatus adapted to receive an output voltage produced by a light sensor according to ambient light and adjust a gamma value to a luminance corresponding to the output voltage of the light sensor to automatically control the luminance of an organic light emitting display device, the automatic brightness control apparatus comprising:

an A/D converter adapted to receive the output voltage of the light sensor, compare the output voltage of the light sensor with a reference voltage, and convert the output voltage of the light sensor into a digital signal;

a Vsync counter adapted to receive a vertical synchronization (Vsync) signal, count the Vsync signal a number of times, and output the Vsync signal;

an A/D controller adapted to receive the digital signal from the A/D converter, synchronize the digital signal with the Vsync signal output from the Vsync counter, and output a control signal;

a gamma controller adapted to output one of the previously stored gamma values in response to the control signal output from the A/D controller;

a first automatic brightness controller adapted to control operations of the A/D converter, the Vsync counter, the A/D controller, and the gamma controller; and a gamma circuit adapted to output a gamma reference voltage corresponding to the gamma value output from the gamma controller, wherein the A/D controller is adapted to sense a change in the output voltage of the light sensor by synchronizing the output voltage of the light sensor with the Vsync signal.

7. The automatic brightness control apparatus of claim 6, wherein the gamma controller comprises:

a gamma register adapted to store a number of gamma values, one of which is selected when an automatic brightness control mode is turned on;

a gamma setting register adapted to store a reference gamma value that is selected when the automatic brightness control mode is turned off;

a gamma selector adapted to select a gamma value from the gamma register in response to the control signal output from the A/D controller; and a gamma output portion adapted to output the gamma value selected by the gamma selector under the control of the first automatic brightness controller to the gamma circuit.

8. The automatic brightness control apparatus of claim 7, wherein the gamma values comprise red, green, and blue gamma values.

9. The automatic brightness control apparatus of claim 8, further comprising a second automatic brightness controller adapted to transmit a control signal for selecting the reference voltage compared with the output voltage of the light sensor to the A/D converter.

10. An automatic brightness control apparatus adapted to control a gamma value according to an output voltage of a light sensor to automatically control the luminance of an organic light emitting display device, the automatic brightness control apparatus comprising:

an A/D converter adapted to receive the output voltage of the light sensor, compare the output voltage of the light sensor with a reference voltage, and convert the output voltage of the light sensor into a digital signal;

a Vsync counter adapted to receive a vertical synchronization (Vsync) signal, count the Vsync signal a number of times, and output the Vsync signal;

an A/D controller adapted to receive the digital signal from the A/D converter, synchronize the digital signal with the Vsync signal output from the Vsync counter, and output a control signal;

a gamma controller adapted to output one of previously stored gamma values in response to the control signal output from the A/D controller;

a first automatic brightness controller adapted to control operations of the A/D converter, the Vsync counter, the A/D controller, and the gamma controller;

wherein the A/D controller is adapted to sense a change in the output voltage of the light sensor by synchronizing the output voltage of the light sensor with the Vsync signal.

11. The automatic brightness control apparatus of claim 10, wherein the gamma controller comprises:

a gamma register adapted to store a number of gamma values, one of which is selected when an automatic brightness control mode is turned on;

a gamma setting register adapted to store a reference gamma value that is selected when the automatic brightness control mode is turned off;

a gamma selector adapted to select a gamma value from the gamma register in response to the control signal output from the A/D controller; and a gamma output portion adapted to output the gamma value selected by the gamma selector under the control the first automatic brightness controller to the gamma circuit.

12. The automatic brightness control apparatus of claim 11, wherein the gamma controller comprises red, green, and blue gamma values.

13. The automatic brightness control apparatus of claim 12, further comprising a second automatic brightness controller adapted to transmit a control signal for selecting the reference voltage compared with the output voltage of the light sensor to the A/D converter.

* * * * *